US007328589B2

(12) United States Patent
Boone

(10) Patent No.: US 7,328,589 B2
(45) Date of Patent: Feb. 12, 2008

(54) COVER FOR A THROUGH-WALL AIR-CONDITIONER UNIT

(76) Inventor: Terry Boone, 400 Fairhaven Dr., Winthrop Harbor, IL (US) 60096

( * ) Notice: Subject to any disclaimer, the term of this patent is extended or adjusted under 35 U.S.C. 154(b) by 353 days.

(21) Appl. No.: 10/924,013

(22) Filed: Aug. 23, 2004

(65) Prior Publication Data

US 2005/0045506 A1 Mar. 3, 2005

Related U.S. Application Data

(60) Provisional application No. 60/499,518, filed on Sep. 2, 2003.

(51) Int. Cl.
*F25D 23/12* (2006.01)

(52) U.S. Cl. ..... 62/262

(58) Field of Classification Search ..... 62/262, 62/263, 457.2, 506; 244/224; 454/202, 454/203, 284, 330; 248/441.1; 280/770; 165/96; 150/165; 296/136.08
See application file for complete search history.

(56) References Cited

U.S. PATENT DOCUMENTS 2,992,668 A * 7/1961 Collard ..... 150/165
4,308,905 A * 1/1982 Gallagher ..... 150/165
4,332,114 A * 6/1982 Goebel et al. ..... 62/262
4,573,328 A * 3/1986 Bolton et al. ..... 62/263
4,625,784 A * 12/1986 Boroson ..... 150/165
4,729,227 A * 3/1988 Peden ..... 62/263
4,759,194 A * 7/1988 Shapiro ..... 62/262
4,840,041 A * 6/1989 Nervina ..... 62/263
5,097,678 A * 3/1992 Aubuchon ..... 62/506
5,104,085 A * 4/1992 Brice ..... 248/441.1
5,307,849 A * 5/1994 Nelson ..... 150/165
5,479,984 A * 1/1996 Easterbrook et al. ..... 165/96
6,253,569 B1 * 7/2001 Hall ..... 62/457.2

* cited by examiner

*Primary Examiner*—Melvin Jones
(74) *Attorney, Agent, or Firm*—George L. Boller

(57) ABSTRACT

A cover (30) for covering the exterior of a through-wall air-conditioner installation in a building. A sheet of material has a shape that provides a rectangular outer wall (32) for covering a rectangular outer face of the through-wall air-conditioner installation and four sides (34, 36, 38, 40) that are folded inward for covering respective sides of the installation and joined at their ends to form four distinct corners for fitting to four corners of the installation. A hem (62) runs along the inner edge margins of the sides and encloses an elastic cord (60) that elongates to a stretched condition to allow the cover to fit over the exterior end of the installation for placing the sides in overlapping relation to the sides of the installation and that exerts a holding force for holding the hem against the four sides of the installation.

14 Claims, 4 Drawing Sheets

COVER FOR A THROUGH-WALL AIR-CONDITIONER UNIT

REFERENCE TO A RELATED APPLICATION AND PRIORITY CLAIM

This application claims the benefit of U.S. Provisional Application No. 60/499,518, filed 2 Sep. 2003.

FIELD OF THE INVENTION

This invention relates to a cover for covering the exterior of a through-wall air-conditioner unit.

BACKGROUND OF THE INVENTION

A through-wall air-conditioner unit is one that mounts in an opening in a wall of a building, such as a home, hotel, motel, apartment, townhouse, office, etc. The opening extends from the exterior of the wall to an interior space within the building.

To provide for more convenient installation of the air-conditioner unit, and service and/or replacement of the unit when needed, a metal sleeve that is open at both ends lines the wall opening. Because the typical air-conditioner unit has a rectangular shape, the sleeve has an open rectangular transverse cross section just slightly larger than that of the unit, allowing the unit to be slid into and out of the sleeve, typically through the end that opens to the building interior. The outside perimeter of the sleeve is typically sealed to the wall opening in any suitably appropriate way.

The interior end of the air-conditioner unit contains controls and the interior air circuit. Interior room air is drawn through an air inlet and passes across an evaporator where it is cooled. It is then blown back into the interior.

A condenser is located at the exterior end of the unit where it is open to the outside air through the open exterior end of the sleeve.

The refrigeration circuit comprises a compressor that sucks refrigerant through the evaporator and forces it into the condenser where heat is rejected to the outside air.

During non-air-conditioning seasons, it may be desirable to cover the exterior end of the unit, particularly for functional reasons. If the clearance between the unit and the sleeve is not fully sealed, winds or drafts may pass through between exterior and interior, occasioning heat loss from the interior. Hence, covering the exterior can reduced heat loss due to less than perfect sealing between the unit and the sleeve.

Covers are sometimes homemade without a great deal of concern for their exterior appearance. Homemade covers may look unattractive and be constructed less than perfectly in which case they may not fully block all air leaks. In a building that has multiple dwelling or office units each equipped with one or more through-wall air-conditioner units, such as an apartment or office building, individual tenants who do not cover their units may experience drafts and heat loss, or if they do cover them, they may do so in different ways that can result in substantial variations in appearance from the outside of the building. The individual covers and lack of uniformity may be considered unsightly and detract from the appearance which a property owner desires in order to attract new tenants.

Various forms of covers for air-conditioner units are disclosed in the following U.S. patents that were developed in preliminary searching: U.S. Pat. Nos. 4,019,556; 4,308,905; 4,325,229; 4,332,114; 4,625,784; 4,745,769; 4,788,805; 5,125,197; 5,307,849; 6,397,617; and 6,430,954. None of those patents is seen to show or suggest the inventive cover.

SUMMARY OF THE INVENTION

It is believed that a through-wall air-conditioner cover that can provide improved appearance and essentially complete blocking of drafts, and that can be easily installed and removed, would represent a meaningful improvement. The present invention relates to a new and improved cover for a through-wall air-conditioner unit that possesses these attributes. The invention also relates to a building air conditioner installation having such a cover during non-use.

DESCRIPTION OF THE INVENTION

Figure 1:
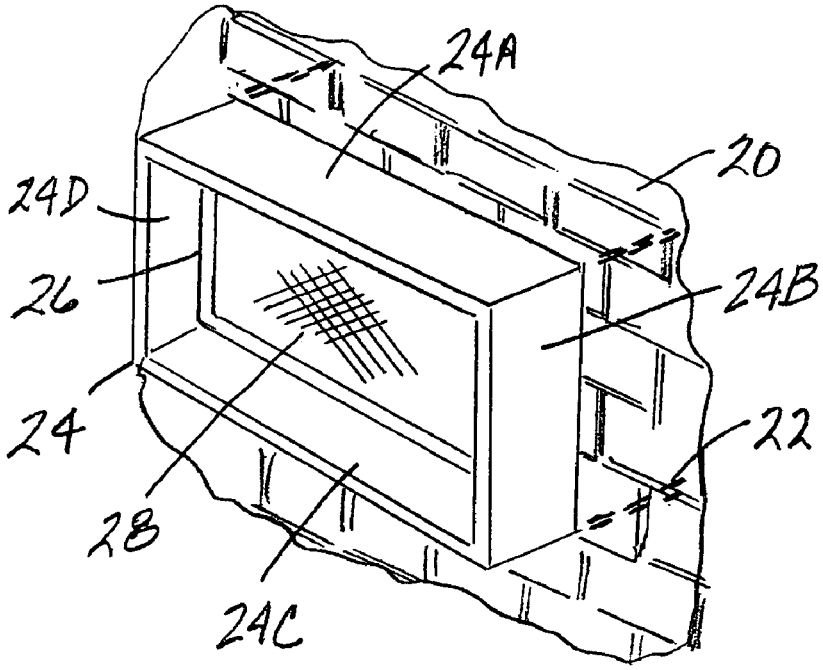
FIG. 1 is a perspective view of a through-wall air-conditioner unit as viewed from the exterior of a building.

FIG. 1 shows an outside wall 20 of a building. An opening 22 that is rectangular in cross section extends completely through wall 20 between the exterior of wall 20 and the building interior. A metal sleeve 24 that is rectangular in transverse cross section is set into opening 22, and typically sealed to the opening so that air cannot intrude between the interior and exterior. An air-conditioner unit 26, like the one described above, is disposed within sleeve 22. A portion of the exterior end of unit 26 can be seen in FIG. 1. That portion contains a condenser 28. Sleeve 24 comprises four walls 24A, 24B, 24C, 24D, and has a length that allows it to protrude to some extent from the exterior of wall 20.

Figure 2:
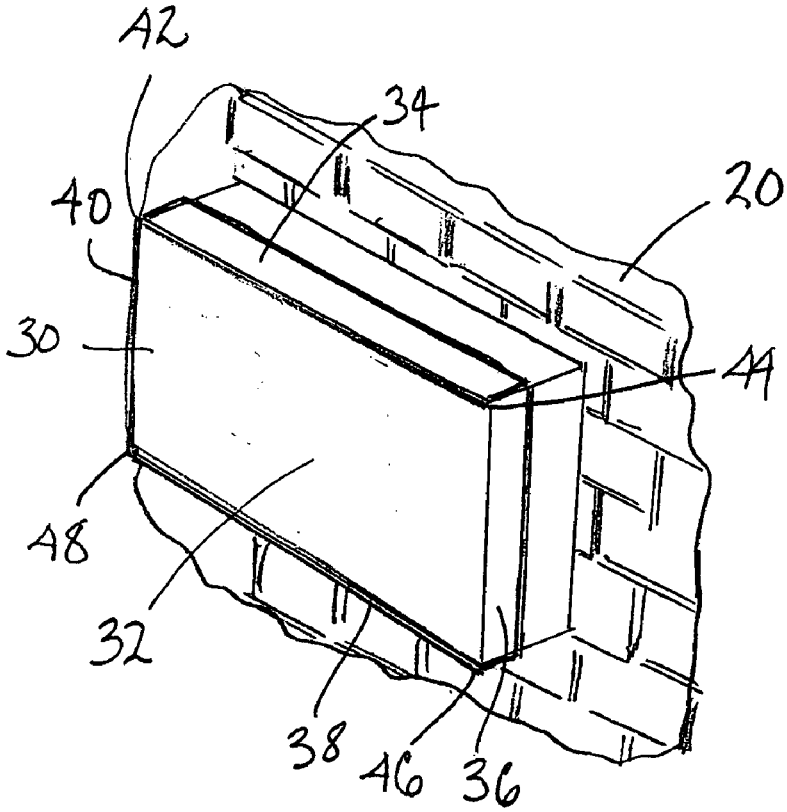
FIG. 2 is a view similar to FIG. 1 but with the inventive cover in place covering the exterior of the air-conditioner unit.
Figure 3:
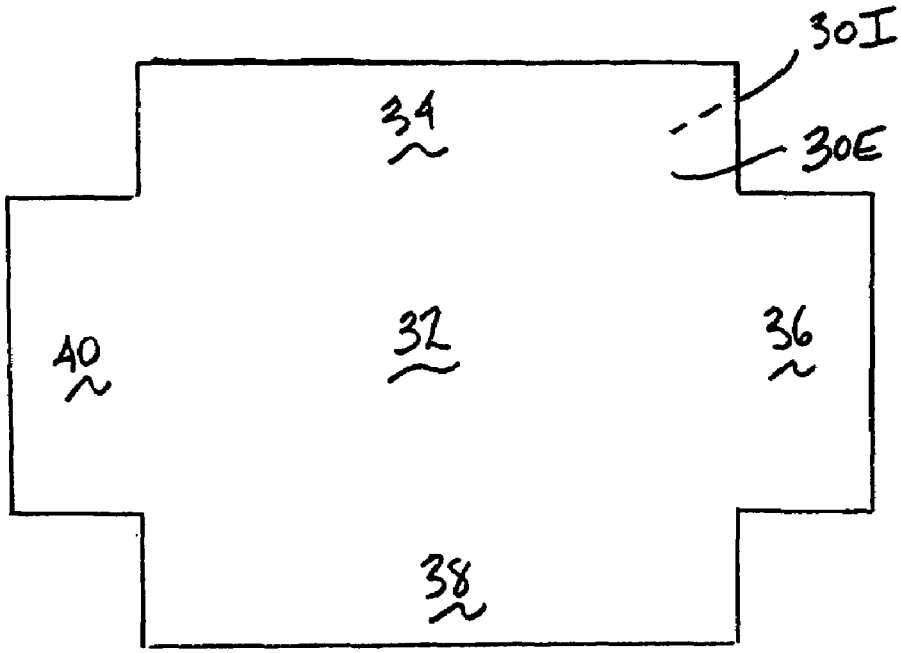
FIG. 3 is a plan view of a pattern for the inventive cover.

FIG. 2 shows a cover 30 embodying principles of the invention covering the open exterior end of sleeve 24, thereby covering the open exterior end of the air-conditioner unit. Cover 30 is fabricated from a sheet of material cut to a shape that in the completed cover provides a rectangular outer end wall 32 for covering the open exterior end of sleeve 24 and four side walls 34, 36, 38, 40 folded inward from outer wall 32 for overlapping the exterior ends of respective sleeve walls 24A, 24B, 24C, 24D. Opposite ends of each cover side wall 34, 36, 38, 40 join with juxtaposed ends of adjoining cover side walls to create four distinct corners 42, 44, 46, 48.

The free edge margins of side walls 34, 36, 38, 40 serve to create a hem that encloses an elastic shock cord that girdles the open end of cover 30 opposite outer end wall 32. When the cord is not being stretched, it has a length less than the nominal length of the hem, causing the hem to contract in length due to gathering and puckering of the material. When cover 30 is to be installed over sleeve 24, the hem elongates with the stretching of the cord. The nominal perimeter length of the hem when the hem is not gathered and puckered is slightly greater than the perimeter of sleeve 24, allowing the open end of the cover to fit over the sleeve when the cord is stretched to the extent allowed by the nominal length of the perimeter of the open end of the cover.

When installed, cover 30 is positioned on sleeve 24 to overlap essentially the full extent of each cover side wall 34, 36, 38, 40 with sleeve side walls 24A, 24B, 24C, 24D and lodge the four corners of the exterior end of sleeve 24 in the four corners 42, 44, 46, 48 of cover 30.

The method of making cover 30 is described with reference to FIGS. 3-9. A sheet of material is cut to the pattern shown in FIG. 3. The appearance of outer wall 32 and side walls 34, 36, 38, 40 in the pattern are marked. The four corners of the pattern are then folded and stitched in particular ways to create corners 42, 44, 46, 48. Subsequently the shock cord is placed, and the free edge margins of the cover side walls are folded back over the shock cord, forming the hem that encloses the cord in the process, and the free edges are then stitched in place.

Figure 4:
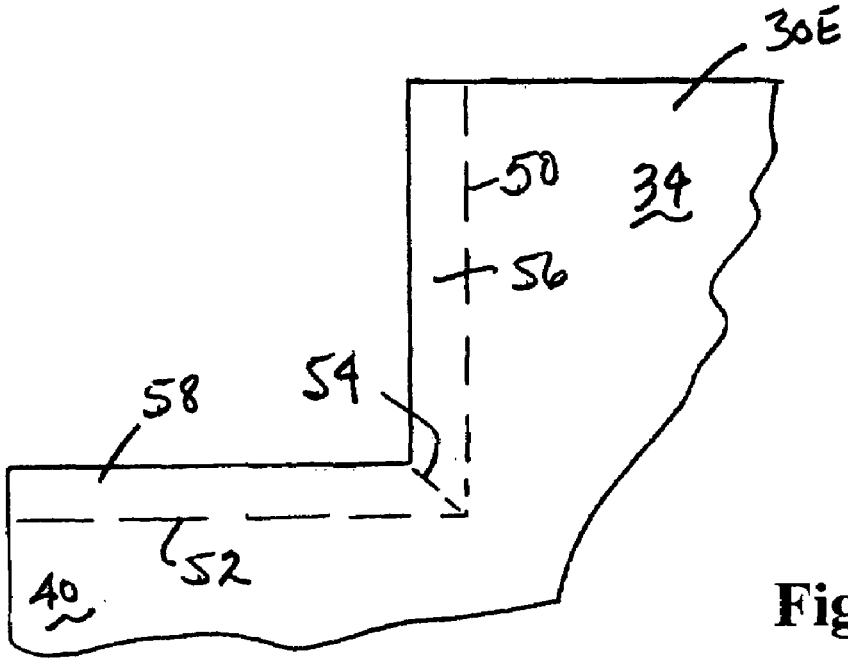
FIG. 4 is in an enlarged view of one of the four corners of the pattern of FIG. 3.
Figure 5:
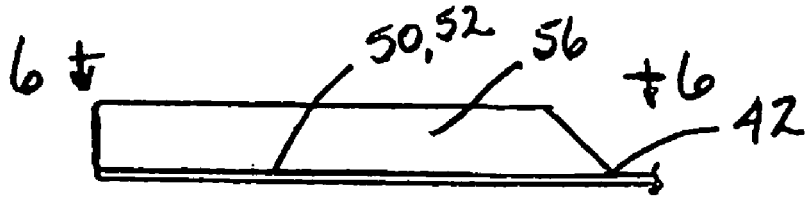
FIG. 5 is a view showing a step in the process of creating a corner of the cover from the corner of the pattern shown in FIG. 4.
Figure 6:
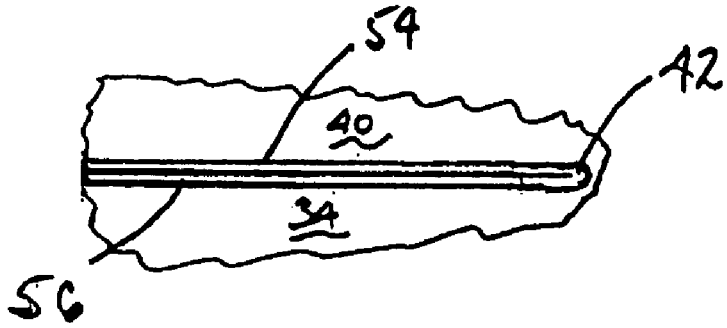
FIG. 6 is a view looking in the direction of arrows 6-6 in FIG. 5.
Figure 9:
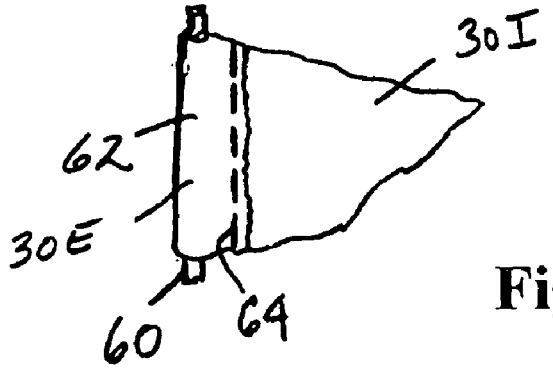
FIG. 9 is a view similar to FIG. 8 showing a hem formed to enclose the elastic shock cord.
Figure 10:
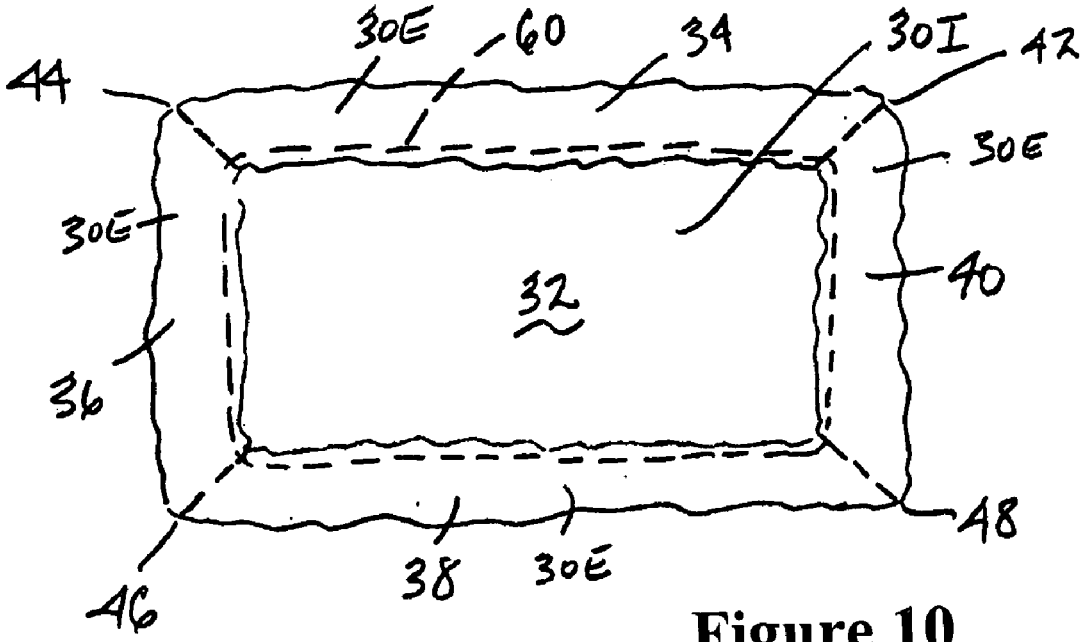
FIG. 10 is an elevation view looking at the interior of the completed cover by itself before installation on a through-wall air-conditioner unit.

FIG. 4 shows how the corner-making process is performed at one corner 42. Similar processes are performed at the other corners. The outer face of the material of cover 30 is designated 30E, and as shown in FIGS. 9 and 10, the inner face is designated 30I. The cover material is manipulated to place the adjoining side walls 34, 40 at right angles to each other. The manipulation includes folding along fold lines 50, 52, 54 to congruently abut one trapezoidal-shaped zone 56 with another trapezoidal-shaped zone 58 such that face 30E of zone 56 and face 30E of zone 58 are mutually abutting, as portrayed by FIGS. 5 and 6. The abutted zones are then stitched along confronted fold lines 50, 52, as indicated by FIG. 5, placing the zones 56, 58 on the interior of the corner 42 that has been created.

Figure 7:
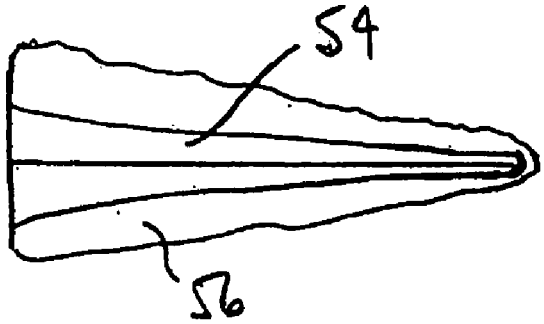
FIG. 7 is a view similar to FIG. 6 illustrating a further stage of the process.

Because the cover material can be folded, but preferably not stretched, the ends of zones 56, 58 opposite fold line 54 can be folded flat against respective adjoining portions of the cover, as shown by FIG. 7. When so folded, it is the inner face 30I of cover material at the end of each zone 56, 58 that abuts the inner face 30I of adjoining cover material. After all four corners have been created, the elastic shock cord can be assembled to the cover and enclosed by the creation of the perimeter hem.

Figure 8:
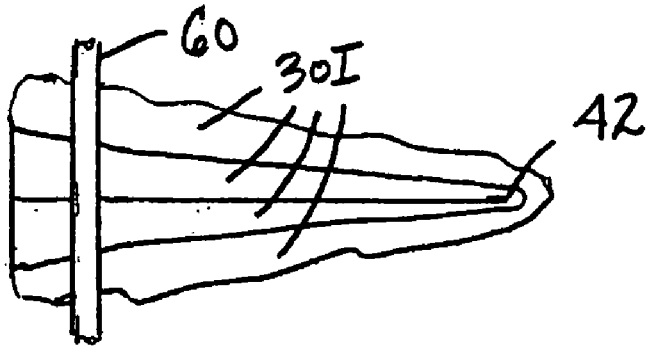
FIG. 8 is a view of the same portion shown in FIG. 7, but includes an elastic shock cord.

FIG. 8 shows the placement of a shock cord 60 on face 30I, spaced inward of the free outer edge of cover material in the vicinity of corner 42. The cord is similarly spaced along each side wall and at the other corners. This placement allows the free edge margins to be folded back over and around the shock cord to form a hem 62 that encloses the cord. After that folding, the edges of the free edge margins abutting the inner face of the cover and are then stitched to the side walls along a line of stitching 64 shown in FIG. 9.

Because the cord is not being stretched during stitching of the hem, the material that forms the hem gathers along the portion of the length of the hem that has been stitched so that stitching is conducted between flat portions of the zones being stitched. After the stitching has been completed, the material in the hem will gather and pucker, as shown in FIG. 10.

The completed cover has an inner free edge whose perimeter length is contracted from what it was prior to assembly of shock cord 60 and creation of hem 62 because cord 60 is not being stretched.

When the cord is stretched to allow the cover to be installed, hem 62 ungathers, causing the open end of the cover to enlarge for fitting onto the end of sleeve 24. The tension created by the stretching of cord 60 forces hem 62 against the sides of sleeve 24, proving a forceful surface-to-surface contact of the inner perimeter of the cover to the sleeve.

From the description that has been given, the reader can appreciate that the cover can be easily installed and removed without the use of tools. It provides effective blocking of air leaks through the sleeve when in use, and it can be folded for storage when removed. It can also provide some degree of protection for the unit against dust, dirt, weather, and insects. A desirable material for cover 30 is fleece-lined vinyl. The vinyl provides the material for outer face 30E, and the fleece, the material for inner face 30I. The shock cord is an endless loop of elastic material that can expand and contract in length.

The vinyl is available in different colors affording a property owner the choice of colors. Covers can be fabricated in different sizes to suit the sizes of various commercially available sleeves. If for some reason a sleeve were not used, a cover could be sized to fit directly on a unit. Covers that embody the invention are at the present time being sold under the name "BREEZEBLOCKER".

From the description given, the invention, apart from various specific inventive features, has been shown to generally provide:

a cover for covering the exterior of a through-wall air-conditioner installation and comprises:

a sheet of material having a shape that provides a rectangular outer wall for covering a rectangular outer face of the through-wall air-conditioner installation and four sides that are folded inward for covering respective sides of the installation and joined at their ends to form four distinct corners for fitting to four corners of the installation, a hem that runs along the inner edge margins of the sides and encloses an elastic cord that elongates to a stretched condition to allow the cover to fit over the exterior end of the installation for placing the sides in overlapping relation to the sides of the installation and that exerts a holding force for holding the hem against the four sides of the installation.

While a presently preferred embodiment of the invention has been illustrated and described, it should be appreciated that principles of the invention apply to all embodiments falling within the scope of the following claims.

What is claimed is:

1. A cover for covering the exterior of a through-wall air-conditioner installation comprising:

a sheet of material having a shape that provides a rectangular main wall for covering a rectangular outer face of the through-wall air-conditioner installation and four side walls that are folded inward from the rectangular main wall for covering respective sides of the installation and joined to cooperate with the rectangular main wall in forming four distinct corners for fitting to four corners of the installation, a hem that runs along the inner edge margins of the side walls and encloses an elastic cord that elongates to a stretched condition to allow the cover to fit over the exterior end of the installation for placing the side walls in overlapping relation to the sides of the installation and that exerts a holding force for holding the hem against the four sides of the installation, wherein the sheet of material has a pattern that when initially cut from flat stock material provides each side wall as a respective rectangular flap adjoining a respective side of the rectangular main wall, with each side edge of each flap being at a right angle to a respective adjacent side edge of each adjacent flap, and with the side walls folded inward, a margin of each side edge of each flap and a margin of the adjacent side edge of each adjacent flap are in mutual face-to-face confrontation.

2. A cover as set forth in claim 1 wherein the sheet of material comprises a fleece-lined synthetic material arranged such that the synthetic material forms an exterior face of the cover, and fleece lining forms an interior face.

3. A cover as set forth in claim 2 wherein the synthetic material comprises vinyl.

4. A cover as set forth in claim 1 wherein the sheet of material is essentially non-stretchable and is gathered and puckered along the length of the elastic cord when the elastic cord is not elongated to stretched condition.

5. A cover as set forth in claim 1 wherein a respective stitching secures each pair of mutually confronting margins together, with the stitching being spaced from the side edges of the mutually confronting margins.

6. Building air-conditioning equipment comprising:

a through-wall air conditioner installation, including an air-conditioner unit, for cooling interior space on an interior side of a building wall and rejecting heat to an exterior space on an exterior side of the wall; and a cover covering the installation on the exterior side of the wall during non-use of the unit;

the cover comprising sheet material having a shape that provides a main wall for covering an outer end of the installation at the exterior side of the wall and side walls that extend inward from the main wall to cover respective sides of that outer end and that cooperate with the main wall in forming distinct corners for fitting to corners of the installation, a hem that runs along the side walls and encloses an elastic cord that elongates to a stretched condition to allow the cover to fit over the outer end of the installation for placing the side walls in overlapping relation to the sides of the installation and that exerts a holding force for holding the hem against the sides of the installation, wherein the sheet material has a pattern that when initially cut from flat stock material provides each side wall as a respective rectangular flap adjoining a respective side of the main wall, with each flap comprising side edges each of which is at a right angle to a respective adjacent side edge of a respective adjacent flap, and wherein with the side walls folded inward, a margin of each side edge of each flap and a margin of the adjacent side edge of each adjacent flap are in mutual face-to-face confrontation.

7. Building air-conditioning equipment as set forth in claim 6 wherein the installation includes a sleeve lining a through-opening in the wall and within which the unit is disposed, and the hem of the cover is held against the sleeve.

8. Building air-conditioning equipment as set forth in claim 7 wherein the sleeve has four sides forming a rectangular cross section, and cover comprises four side walls each held against a respective side of the sleeve.

9. Building air-conditioning equipment as set forth in claim 8 wherein the sheet material is essentially non-stretchable.

10. Building air-conditioning equipment as set forth in claim 8 wherein the sheet material comprises a fleece-lined synthetic material arranged such that the synthetic material forms an exterior face of the cover, and fleece lining forms an interior face.

11. Building air-conditioning equipment as set forth in claim 10 wherein the synthetic material comprises vinyl.

12. Building air-conditioning equipment as set forth in claim 6 wherein a respective stitching secures each pair of mutually confronting margins together in face-to-face contact, with the stitching being spaced from the corresponding side edges.

13. Building air-conditioning equipment as set forth in claim 6 wherein each of the margins of each pair of mutually confronting margins has a trapezoidal shape.

14. A cover as set forth in claim 1 wherein each of the margins of each pair of mutually confronting margins has a trapezoidal shape.

* * * * *